United States Patent [19]

Okitsu et al.

[11] 4,164,207

[45] Aug. 14, 1979

[54] EXHAUST GAS RECIRCULATION MEANS

[75] Inventors: Kingo Okitsu; Koji Asanomi; Setsuo Harada; Yasunori Takemoto, all of Hiroshima, Japan

[73] Assignee: Toyo Kogyo Co., Ltd., Hiroshima, Japan

[21] Appl. No.: 808,355

[22] Filed: Jun. 20, 1977

[30] Foreign Application Priority Data

Jun. 19, 1976 [JP] Japan ..... 51/72329
Jun. 22, 1976 [JP] Japan ..... 51/75050

[51] Int. Cl.[2] ..... F02N 25/06
[52] U.S. Cl. ..... 123/119 A
[58] Field of Search ..... 123/119 A

[56] References Cited

U.S. PATENT DOCUMENTS

| | | | |
|---|---|---|---|
| 3,872,845 | 3/1975 | Schultz | 123/119 A |
| 4,041,913 | 8/1977 | Nohira | 123/119 A |
| 4,047,509 | 9/1977 | Arnaud | 123/119 A |

*Primary Examiner*—Wendell E. Burns
*Attorney, Agent, or Firm*—Wenderoth, Lind & Ponack

[57] ABSTRACT

An exhaust gas recirculation system has at least two recirculation lines to permit recirculation of a large quantity of exhaust gas when required and in which recirculation of exhaust gas is reduced or completely cut off in accordance with particular engine operating conditions.

4 Claims, 6 Drawing Figures

EXHAUST GAS RECIRCULATION MEANS

BACKGROUND OF THE INVENTION

The present invention relates to means for recirculation of exhaust gas of an internal combustion engine in an automotive vehicle. More particularly, the invention relates to an exhaust gas recirculation means in which the amount of recirculated exhaust gas is varied or is made zero in accordance with engine operating conditions.

A known technique for reduction of emission of pollutants, particularly nitrogen oxides, in the exhaust gases of an internal combustion engine which are discharged to the atmosphere is to recycle a portion of the exhaust gases to a stage preceding the combustion stage, usually to the carburetor.

In a means according to one conventional approach, the air-fuel mixture is made leaner or richer than the theoretical air-fuel ratio of 15, at which nitrogen oxide emission is maximum, and a comparatively small amount of exhaust gas is recirculated. However, there are definite limits to the amount of reduction of $NO_x$ emission that can be achieved by such a means.

To provide increased control of $NO_x$ emission in order to meet the requirements of government or other regulations without having an excessively adverse effect on average engine operating conditions, it has therefore been proposed to set the air-fuel ratio at the theoretical ratio and to greatly increase the amount of recirculated exhaust gas.

To achieve recirculation of the desired large amounts of exhaust gas it has been proposed to introduce the recirculated gas into a carburetor via separate ducts which are upstream and downstream of the throttle valve in the carburetor, i.e., upstream and downstream in terms of air flowing through the carburetor, and, in order to maintain the ratio of recirculated exhaust gas to the air-fuel intake more or less constant over the range of moderately low to moderately high load conditions for the engine, to make the upstream supply of recirculated exhaust gas proportional to the air intake and the downstream supply proportional to the pressure downstream of the venturi section of the carburetor. In conventional means, control of the flow rates of recirculated exhaust gas is effected simply by orifices, and the large amount of exhaust gas recirculated by conventional means is very disadvantageous in certain operating conditions. In particular, when a vehicle transmission is set to operation in a high speed range, recirculation of a large amount of exhaust gas inevitably leads to reduced engine output and/or increased fuel consumption rates. Alternatively, depending on ambient temperature conditions and relative humidity of the intake air, recirculated exhaust gas, which has a high moisture content, is liable to cause icing in the carburetor. These points, however, are largely ignored in conventional recirculation means which concentrate on achieving recirculation of requisite amounts of exhaust gas based on average operating conditions of an engine.

SUMMARY OF THE INVENTION

It is accordingly a principal object of the present invention to provide an improved exhaust gas recirculation means which permits recirculation of desired large amounts of exhaust gas during average operating conditions, but causes the supply of recirculated exhaust gas to be reduced or cut off as necessary during special engine operating conditions.

It is another object of the invention to provide an exhaust gas recirculation means which is easily adjustable to change the amount of recirculated exhaust gas for different sets of conditions, to meet requirements of vehicles or other means driven by an internal combustion engine.

It is a further object of the invention to provide an exhaust gas recirculation means which has a simple construction and is easily associated with a conventional carburetor.

In accomplishing these and other objects, there is provided according to the present invention an exhaust gas recirculation means in which exhaust gas is recirculated into the carburetor of an internal combustion engine via two ports, one upstream of and the other downstream of the throttle valve in the carburetor, and in which recirculation lines leading to these ports are closed by the action of valve elements controlled by a control unit which receives an input signal which indicates that the vehicle transmission is set to operation in a high speed range and in response to which the control unit causes only the upstream recirculation in line to be closed.

In a preferred embodiment, the control unit receives an input signal indicative of conditions under which icing is liable to be caused by the recirculation of the exhaust gas into the upstream portion of the carburetor, and/or an input signal which indicates that the engine is being warmed up, and in response to which the control unit causes both recirculation lines to be closed.

In conditions in which icing is liable to occur, only the upstream supply of the recirculated exhaust gas is stopped. In this manner, the means of the invention ensures that the desired large amount of exhaust gas is recirculated during operation of the engine in standard conditions while avoiding adverse effects liable to be caused by the recirculated exhaust gas in more unusual or extreme sets of conditions.

BRIEF DESCRIPTION OF THE DRAWING

A better understanding of the invention may be had from the following full description of several preferred embodiments thereof when read in reference to the attached drawings, in which like numbers, refer to like parts, and in which.

DETAILED DESCRIPTION OF THE INVENTION

Figure 1:
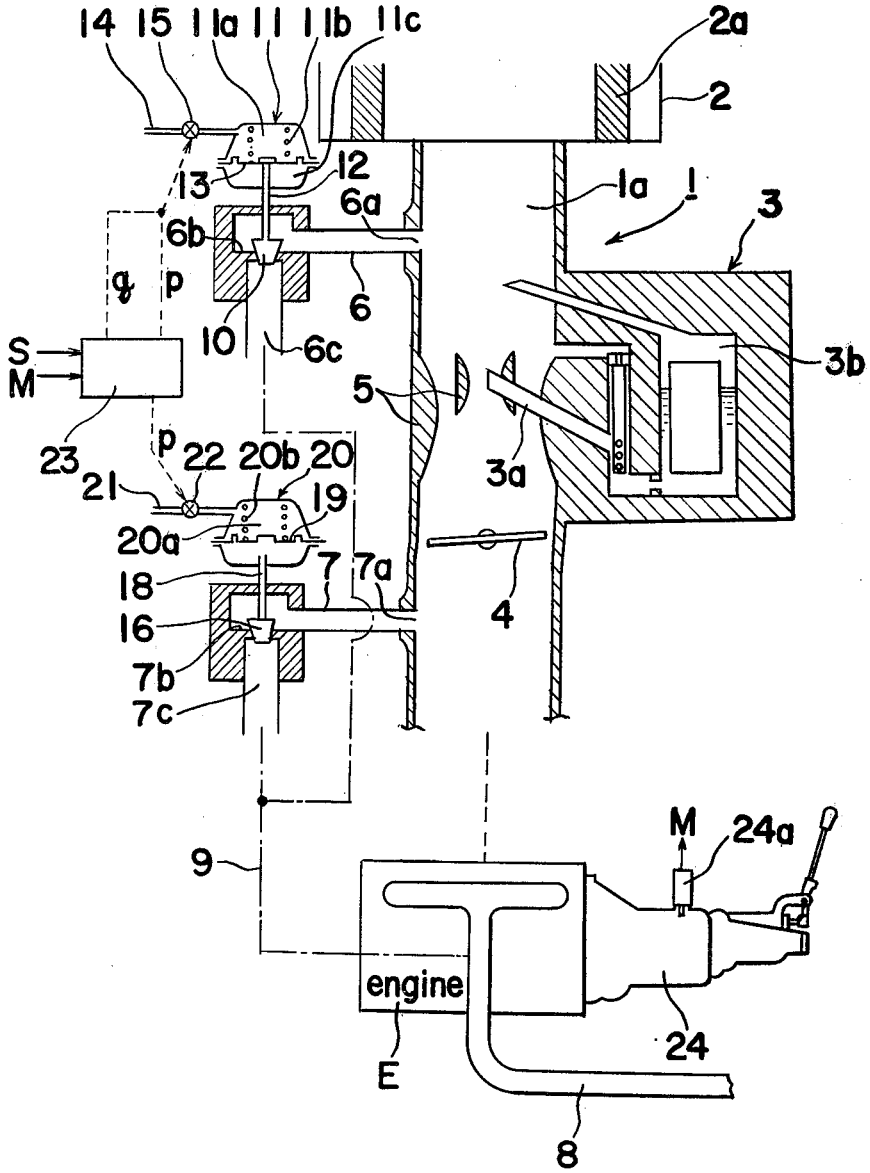
FIG. 1 is a schematic cross-sectional view showing the main features of an exhaust gas recirculation means according to a first embodiment of the invention.

Referring initially to FIG. 1, there is shown a carburetor 1 comprising an air intake circuit 1*a* which leads to a venturi section 5, a main nozzle 3*a* providing communication between a fuel float system 3*b* and the venturi section 5, and a throttle valve 4 downstream of the venturi section 5, i.e., on the opposite side of venturi section 5 from the air intake circuit 1*a*, and which produces an air-fuel mixture in a conventionally known manner and supplies the mixture to be burned in one or more combustion chambers of an engine, indicated schematically at E. The carburetor 1 may include other conventionally known elements such as a choke valve, an idle port, and a low speed port, not shown. In terms of air flow into the carburetor 1, the air intake circuit 1*a* is preferably preceded by an air cleaner 2 comprising a filter 2*a*. Gases produced by combustion of the mixture are exhausted from engine E through an exhaust pipe 8 and a portion thereof is taken off from the exhaust pipe 8 by a take-off line 9 and supplied by line schematically indicated at 9 into the intake ends 6*c* and 7*c* of a first recirculation line 6 and a second recirculation line 7, respectively, lines 6 and 7 being separate from each other and connected to separate branch lines of take-off line 9.

The first recirculation line 6 forms part of a first exhaust gas recirculation means and has a delivery end 6*a* which opens into a portion of carburetor 1 which is upstream of throttle valve 4 and, in this embodiment, is upstream of venturi section 5 also. Flow of exhaust gas through the recirculation line 6 can be throttled or completely stopped by a first flow control valve 10 which is seated on a valve seat 6*b* defined by wall portions of the recirculation line 6 and the degree of opening of which is controlled by a diaphragm 13 through a rod 12 having one end attached to the first flow control valve 10 and the opposite end connected to one side of the diaphragm 13 extending across a first diaphragm unit 11. The portion of the diaphragm unit 11 which is in part bounded by the side of the diaphragm 13 to which the rod 12 is connected is sealed or connected to a constant pressure source and constitutes a constant pressure chamber 11*c*. The portion of the diaphragm unit 11 which is on the opposite side of the diaphragm 13 constitutes a negative pressure chamber 11*a* which is connected through a first control fluid duct 14 to a suitable negative pressure source, for example, a portion of the intake air flow to carburetor 1 which is at reduced pressure. In the control fluid duct 14 there is provided a first stop valve 15 which is controlled in a manner described below by a control unit 23. In the negative pressure chamber 11*a* there is provided a coil spring 11*b* which acts on the flow control valve 10 via the diaphragm 13 and the rod 12 and constantly exerts a force on the control valve 10 urging it toward the valve seat 6*b*. Assuming that the top valve 15 is open, the diaphragm 13 moves against the force of spring 11*b*, due to the force exerted as a result of the difference of pressures in chambers 11*a* and 11*c*, and the control valve 10 is opened to a degree dependent on the amount of movement of the diaphragm 13, and exhaust gas is allowed to flow through the recirculation line 6 into the carburetor 1. By connecting the control fluid duct 14 to a source the pressure of which is proportional to the air flow in the carburetor 1, the movement of the diaphragm 13, and, hence the opening of the flow control valve 10 and the rate of flow of the exhaust gas into the carburetor 1, are varied in accordance with conditions in the carburetor 1, i.e., in accordance with engine operating conditions. When the stop valve 15 is closed, the difference between the pressure in the chamber 11*a* and the pressure in the chamber 11*c* of the diaphragm unit 11 becomes insufficient to counter the force of the spring 11*b*, which therefore seats the flow control valve 10 on the valve seat 6*b*, thereby interrupting the supply of the exhaust gas to the delivery end 6*a* of the recirculation line 6.

Still in FIG. 1, the exhaust gas supplied into the second recirculation line 7 is supplied via the delivery end 7*a* of the line 7 into a portion of the carburetor 1 which is downstream of the throttle valve 4. The recirculation line 7 forms part of a second recirculation system that has basically the same construction and manner of functioning as the above-described first exhaust gas recirculation system and comprises a second flow control valve 16 which is seatable on a valve seat 7*b* defined by wall portions of the line 7 and which controls the flow of the exhaust gas in the line 7, a second diaphragm unit 20 divided into a negative pressure chamber 20*a* and a constant pressure chamber 20*c* by a diaphragm 19 which acts through a rod 18 to control the position of the flow control valve 16, a coil spring 20*b* provided in the negative pressure chamber 20*a* and exerting a constant force tending to cause the diaphragm 19 to seat the flow control valve 16 on the valve seat 7*b*, whereby the flow of the exhaust gas in the line 7 is stopped, a second control fluid duct 21 which connects the negative pressure chamber 20*a* of the diaphragm unit 20 to a suitable negative pressure source, and a second stop valve 22 which is controlled by the control unit 23 and is actuable to open and close the control fluid duct 21 selectively.

Needless to say, instead of being connected to a negative pressure source, the control fluid duct 14 and/or the control fluid duct 21 may be connected to a positive pressure source, in which case the spring 11*b* and/or the spring 20*b* is provided on the other side of the diaphragm of the corresponding diaphragm unit.

The control unit 23 is suitably an electrical or electronic unit, which is not necessarily positioned adjacent to the carburetor 1 in the manner shown in FIG. 1, and which receives input signals s and M. The input signal s indicates that the engine E is warming up, and may be supplied, for example, from a switch actuated by a device which detects the temperature of cooling water in the engine E. The input M is supplied by a transmission switch 24*a* connected to and actuated by the means for shifting the transmission when the shift means is shifted to the high speed range, of a transmission speed change gear 24.

In response to these input signals the control unit 23 supplies as an output a signal p causing the stop valve 15 and the stop valve 22 to close when the warm-up signal s is received, and a signal q to close only the stop valve 15 when only the signal M is received, the stop valve 22 otherwise being left open. This action is achieved by providing in the control unit 23 an output terminal which is connected directly to an input terminal for signal s and supplies an output to the stop valve 22, and an OR circuit the output terminal of which is connected to the stop valve 15 and which receives both signals s and M as an input, for example. The stop valves 15 and 22 may be any type of valve that is actuable by electrical signals, for example, solenoid-controlled valves.

By this action, therefore, recirculation of the exhaust gas is completely stopped during warm-up of engine E and, when suitable running conditions have been achieved, the exhaust gas is recirculated via both lines 6 and 7, but recirculation of excessive amounts of exhaust gas when the vehicle transmission is set to operate in the high speed range is avoided by closure of the recirculation line 6 when these conditions are attained.

Figure 2:
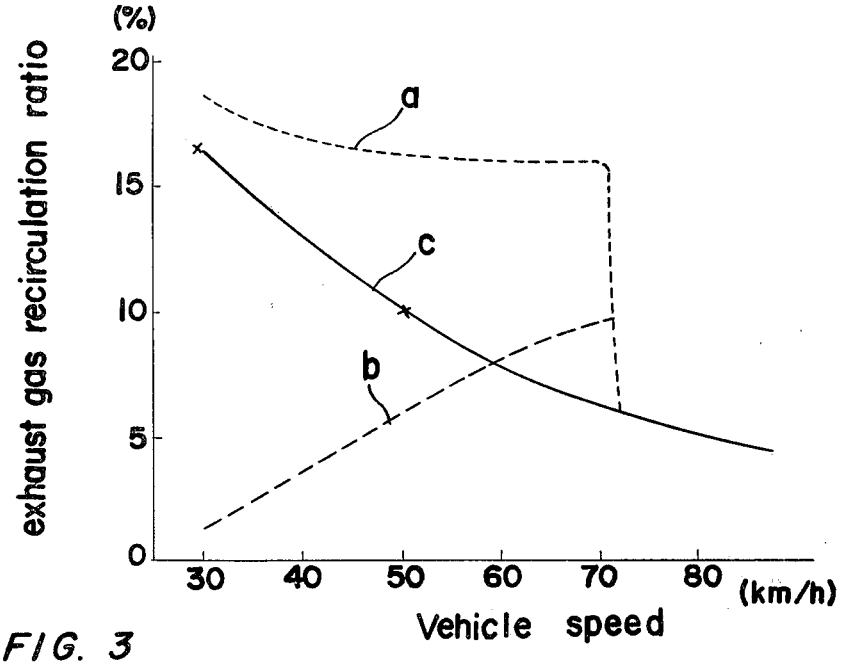
FIG. 2 is a graph showing the relation of exhaust gas recirculation ratio to vehicle speed in the means of FIG. 1.

Results obtained by the means of the invention are illustrated in the graph of FIG. 2 to which reference is now had, and in which the abscissa shows values of vehicle speed, determined directly or on the basis of engine speed, and the ordinate shows values of the exhaust gas recirculation ratio, defined as the amount of recirculated exhaust gas divided by the intake fuel-air mixture and multiplied by 100. The curve a shows the overall recirculation ratio, the curve b the recirculation ratio of the exhaust gas supplied to the upstream portion of the carburetor 1 by the recirculation line 6, and the curve c the recirculation ratio of the exhaust gas supplied to the downstream portion of the carburetor 1 by the recirculation line 7.

Because of the respective locations of the delivery ends 6*a* and 7*a* of the first and second recirculation line 6 and 7, the upstream supply of recirculated exhaust gas tends to increase proportionally to the increased air intake which accompanies increased vehicle or engine speed, whereas the flow of the recirculated exhaust gas via the recirculation line 7 is greatly influenced by the negative pressure downstream of the throttle valve 4 and, therefore, tends to decrease as the vehicle speed increases. The net result is that, in the range of speed of about 30–70 km/h the recirculation ratio of the total amount of exhaust gas supplied into the carburetor 1 via the recirculation lines 6 and 7 remains generally constant at a value somewhat higher than 15%. When the vehicle speed reaches about 70 km/h, the signal M is supplied to operation in the control unit 23 since the vehicle transmission is set to the high speed range in this condition and, consequently, the recirculation ratio drops rapidly to a value of about 4 to 6%. This lowering of recirculation ratio is effected to prevent engine output from falling and to reduce the fuel consumption rates.

Figure 3:
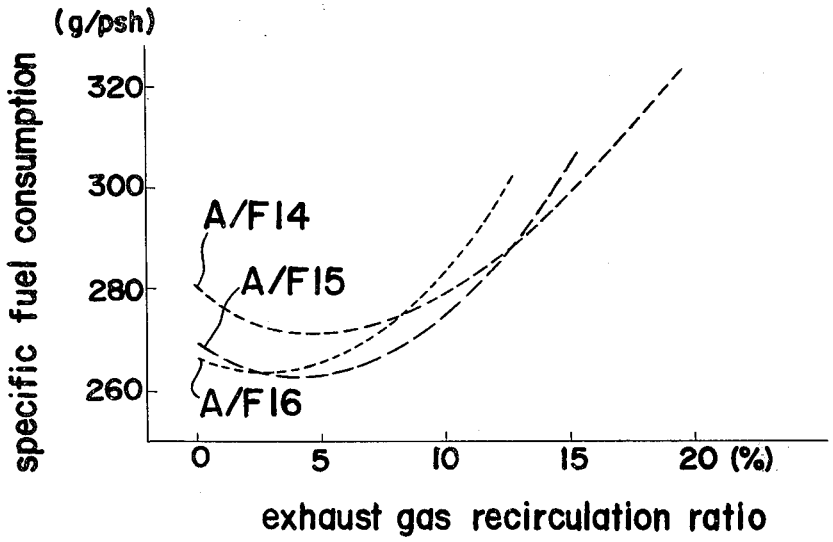
FIG. 3 is a graph showing the relation of specific fuel consumption to the exhaust gas recirculation ratio in the means of FIG. 1.

Reference is now had to FIG. 3, which shows the relation achieved by the means of the invention between the exhaust gas recirculation ratio and the specific fuel consumption when the air-fuel ratio of the mixture produced in the carburetor 1 is 14, 15, and 16 and the engine speed and the mean effective output pressure Pe are maintained constant at 1,500 rpm and 3 $kg/cm^2$, respectively. It is seen that, for all three air-fuel ratios, the fuel consumption is minimum when the recirculation ratio is in the vicinity of 5%.

It is thought that the reason for minimum fuel consumption for the recirculation ratio of about 5% is as follows. In an engine in which an Otto cycle is repeatedly effected, the thermal efficiency is influenced by the ratio of specific heat of the components of a mixed gas, in this case, the air-fuel mixture and recirculated exhaust gas, and the pressure inside of cylinder defining a combustion chamber at the start of the compression stroke. However, since a change in the ratio of the specific heat of the gas mixture components between times when the exhaust gas is recirculated and the exhaust gas is not recirculated is very small, for example, on the order of 1.38:1.40, which may be ignored for practical purposes, the thermal efficiency is directly governed by the pressure in the cylinder, that is, by the amount of recirculated gas and, theoretically, from this point of view, the thermal efficiency should improve as the amount of recirculated exhaust gas is increased. However, since the recirculated exhaust gas is comparatively inert, it tends to lower the speed of combustion, which off-sets the advantages of the increased pressure in the cylinder due to the gas. The net result of these mutually cancelling factors is that maximum thermal efficiency is achieved when the exhaust gas recirculation ratio is in the range of 5 to 10%.

Comparing FIG. 2 and FIG. 3, it is seen that the system of the invention offers the considerable advantage that a minimum specific fuel consumption is achieved when high vehicle speeds are reached, that is, the vehicle transmission is set to operate in the high speed range.

Figure 4:
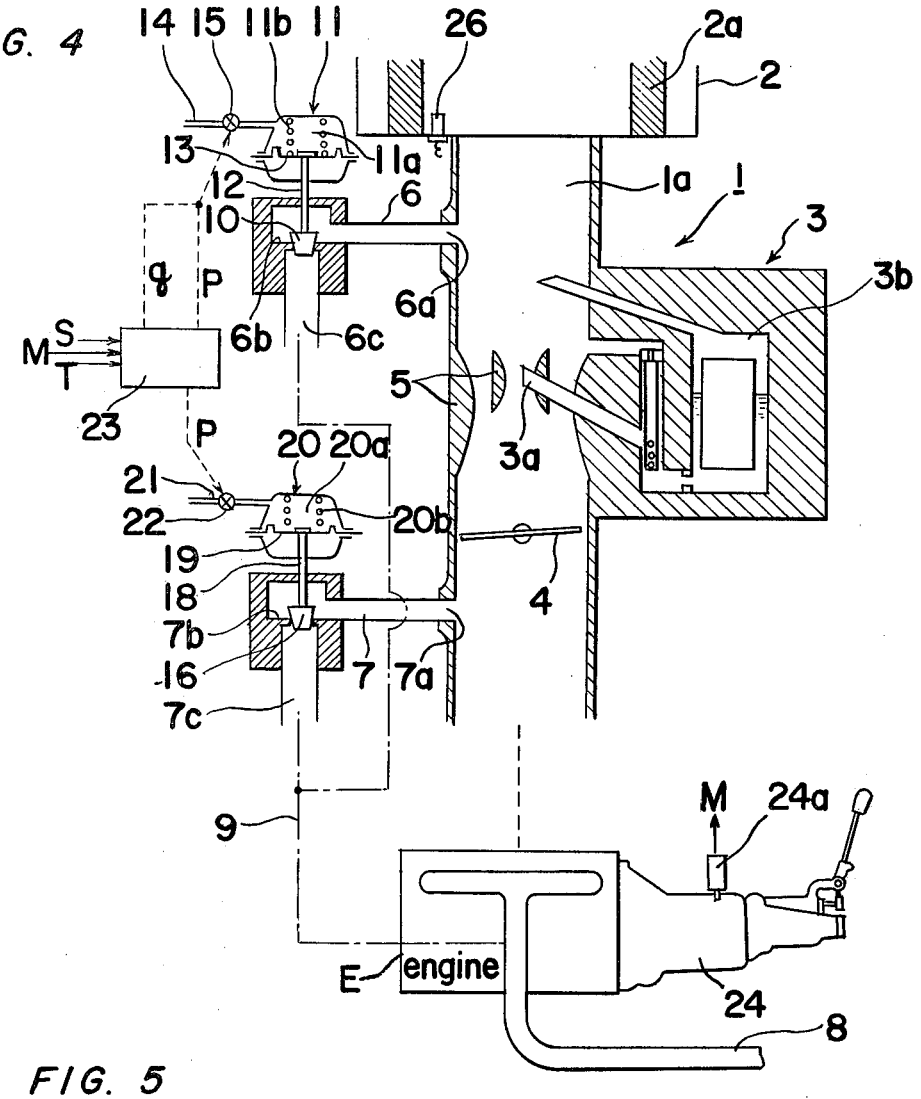
FIG. 4 is a view similar to FIG. 1 and showing another embodiment of the invention.

Referring now to FIG. 4, there is shown another embodiment of the invention in which a control unit 23 further receives, in addition to the signals received in the embodiment in FIG. 1, a signal T indicating that the temperature of the air in the air intake portion of the carburetor 1 is below a certain temperature, and other parts are the same as in FIG. 1. The signal T may be supplied, for example, by a bimetallic element or other suitable means constituting a temperature detector 26 which is mounted on the filter 2*a* adjacent to the inlet of the carburetor 1, and has associated therewith a suitable circuit (not shown) for transmission of signals to the control unit 23.

Figure 5:
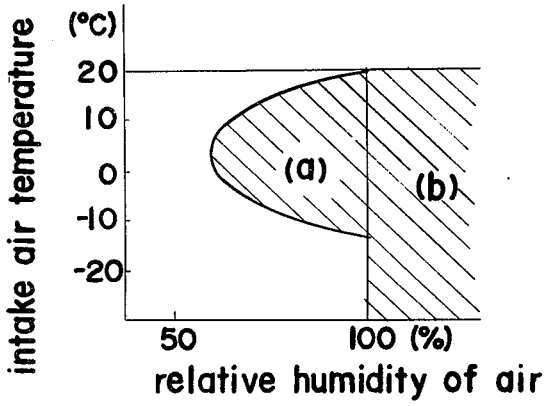
FIG. 5 is a graph showing the relation of icing in a carburetor to intake air temperature and relative humidity of the air in a carburetor.

Referring to the graph of FIG. 5, the abscissa represents values of relative humidity of intake air and the ordinate represents values of the temperature thereof. In the absence of the recirculated exhaust gas admixed therewith, the intake air is practically never in a supersaturated state in which the relative humidity is greater than 100%. The region in which icing is liable to occur is that bounded by the generally-parabolic curve (a) in the drawing, in which the relative humidity is in the range 50–100% and temperature centers on a value of 3°–5° C. and extends up to an upper limit of 20° C. and to a lower limit of close to −15° C. These temperatures noted for the intake air are, of course, influenced to a considerable extent by the temperature of the engine as a whole, and are somewhat higher than the external ambient air temperature. The reason for the upper limit of 20° C. is that, even supposing a certain amount of lowering of temperature of air subsequent to intake thereof due to the latent heat of vaporization, temperatures reached are not such as to permit icing. On the other hand, if the temperature of the intake air is in the vicinity of or lower than about −15° C., although air temperature is favourable into icing, the absolute moisture content of the air is so low that the quantity of ice which may form is insufficient to have any practical effect on the functions of the carburetor. The system of the invention makes no contribution to avoidance of icing in the region bounded by the curve (a) of FIG. 5.

With the addition of the upstream recirculated exhaust gas, however, the relative humidity of the air-fuel mixture in the intake portion of the carburetor readily becomes higher than 100% and icing may occur over the whole range of intake air temperature from below −20° C. to +20° C. In this respect, the system of the invention offers a definite advantage since the supply of the recirculated exhaust gas via the recirculation line 6 is interrupted when the temperature of the intake air is in the range in which admixture of the exhaust gas therewith is liable to cause icing. For the above noted reason, 20° C. is the upper limit of this range, and the temperature detector is therefore preferably made such that a signal T is supplied continuously to the control unit 23 while the intake air temperature is lower than 20° C., but is not supplied when air intake temperature is 20° C. or higher.

Figure 6:
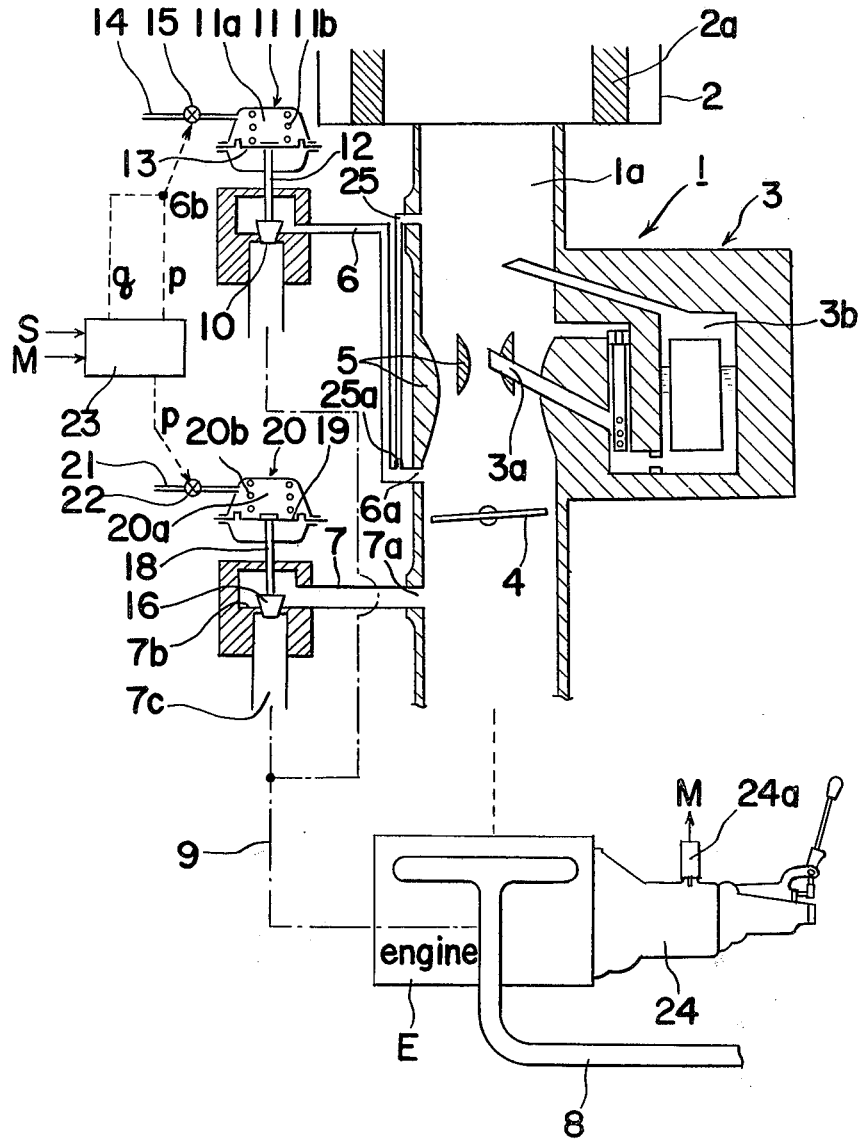
FIG. 6 is a view similar to FIG. 1 and showing another embodiment of the invention.

Referring now to FIG. 6, there is shown another embodiment of the invention in which the delivery end 6a of the recirculation line 6 opens into a portion of the carburetor 1 which is intermediate the venturi section 5 and throttle valve 4 and is also in communication with the delivery end of a supplementary air duct 25, the intake end of which opens into a portion of the carburetor 1 upstream of the venturi section 5. In this embodiment of the invention, the flow rate of air which is delivered via the duct 25 into the carburetor 1 is inversely proportional to the flow rate of the exhaust gas delivered into the carburetor 1 via the recirculation line 6, since the recirculated exhaust gas is at a generally higher pressure than that of the air in the supplementary air duct 25, delivery of air from the duct 25 into the carburetor 1 being completely or almost completely stopped at high flow rates of the exhaust gas in the recirculation line 6, whereby there is automatic enrichment of the air-fuel mixture produced in the carburetor 1 as the exhaust gas recirculation ratio is increased. To ensure a correct supply of the exhaust gas into the carburetor 1, there is suitably provided in the supplementary air duct 25 an orifice element 25a which has a smaller cross-sectional area than that of the delivery end 6a of the recirculation line 6, whereby the duct 25 presents a greater resistance to flow.

In all of the above described embodiments of the invention, the stop valves 15 and 22 may, of course, be directly positioned in the recirculation lines 6 and 7, respectively. The diaphragm units 11 and 20 are preferably included, however, since, as noted earlier, by the connection of the ducts 14 and 21 to a source in which the value of pressure is related to the intake air pressure in the carburetor 1, the rate of exhaust gas recirculation can be varied in relation to operating conditions of the engine E.

Although the present invention has fully been described in connection with the preferred embodiments thereof with reference to the accompanying drawings, it is to be noted that various changes and modifications will be apparent to those skilled in the art. Such changes and modifications are to be construed as being included within the true scope of the present invention unless they depart therefrom.

What is claimed is:

1. In an internal combustion engine having a carburetor including at least a venturi section, a fuel introduction system for introduction of fuel into air passing through said venturi section, and a throttle valve provided downstream of said venturi section, at least one combustion chamber to which the air-fuel mixture is supplied from said carburetor and in which the air-fuel mixture is burned, and exhaust pipe means for exhausting the gases of combustion from said combustion chamber, exhaust gas recirculation means comprising:

a take-off line from said exhaust pipe for taking off of a portion of said exhaust gas flowing in said exhaust pipe means;

a first recirculation line into which exhaust gas is supplied by said take-off line having a delivery end connected to a portion of said carburetor which is intermediate said venturi section and said throttle valve;

a second recirculation line into which exhaust gas is supplied by said take-off line and having a delivery end connected to a portion of said carburetor which is downstream of said throttle valve;

a first recirculation line closure means in said first recirculation line;

a second recirculation line closure means in said second recirculation line;

means for generating a first signal indicative of a vehicle transmission set to operate in a high speed range;

control means connected to said means for generating said first signal for receiving as an input said signal and for causing said first recirculation line closure means to close said first recirculation line upon receipt of said signal for interrupting the supply of exhaust gases in the first recirculation line; and a supplementary air duct having an inlet end communicating with a portion of said carburetor which is upstream of said venturi section and an outlet end communicating with the interior of said first recirculation line.

2. Exhaust gas recirculation means as claimed in claim 1, further comprising means connected to said control means for generating a third signal indicating that said engine is being warmed-up, said control means causing said first and second recirculating line closure means to close said first and second recirculation lines in response to said third signal.

3. Exhaust gas recirculation means as claimed in claim 1, wherein each said recirculation line closure means comprises:

a flow control valve able to throttle or stop the flow of exhaust gas in said recirculation line;

a diaphragm unit comprising a diaphragm which divides said diaphragm unit into a constant pressure chamber and a negative pressure chamber and which is connected to and controls the position of said flow control valve; spring means exerting on said diaphragm a force which acts constantly to cause said diaphragm to move said flow control valve to a closed position and is opposed by a force resulting from the difference of pressure in said chambers of said diaphragm unit, and a duct connecting said negative pressure chamber to a negative pressure source; and a stop valve which is provided on said duct and is controlled by said control means.

4. Exhaust gas recirculation means as claimed in claim 1, further comprising means connected to said control means for generating a second signal indicating that the temperature of air at the intake portion of said carburetor is below a certain value, said control means causing said first recirculation line closure means to close said first recirculation line in response to said second signal.

* * * * *